US006290195B1

(12) United States Patent
Deuer

(10) Patent No.: US 6,290,195 B1
(45) Date of Patent: Sep. 18, 2001

(54) MOUNTING BRACKET SYSTEM FOR SUPPORTING ACCESSORIES ON A STRUCTURE

(76) Inventor: Joseph F. Deuer, 560 W. David Rd., Kettering, OH (US) 45429

( * ) Notice: Subject to any disclaimer, the term of this patent is extended or adjusted under 35 U.S.C. 154(b) by 0 days.

(21) Appl. No.: 09/410,013

(22) Filed: Sep. 30, 1999

(51) Int. Cl.[7] ..... A47B 96/06
(52) U.S. Cl. ..... 248/230.8; 248/231.85
(58) Field of Search ..... 248/230.8, 230.9, 248/218.4, 219.4, 231.85; 24/69 WT, 70 CT, 71 CT; 254/199, 262, 237

(56) References Cited

U.S. PATENT DOCUMENTS

| | | | | |
|---|---|---|---|---|
| 1,395,308 | * | 11/1921 | Sykes | 248/230.9 |
| 1,408,900 | * | 3/1922 | Miller | 248/230.8 |
| 1,432,561 | | 10/1922 | Johnson . | |
| 1,483,592 | * | 2/1924 | Pelstring | 248/230.8 |
| 1,542,548 | * | 6/1925 | Gordon . | |
| 1,849,789 | * | 3/1932 | Coffing | 248/230.8 |
| 3,241,800 | * | 3/1966 | Richter | 248/230.9 |
| 3,888,446 | | 6/1975 | O'Brien et al. . | |
| 4,040,589 | * | 8/1977 | McLay . | |
| 4,066,233 | | 1/1978 | Heard . | |
| 4,325,529 | | 4/1982 | Seebinger . | |
| 4,341,029 | | 7/1982 | Heard . | |
| 4,569,497 | * | 2/1986 | Elmer | 248/230.9 |
| 4,678,147 | | 7/1987 | Barnes et al. . | |
| 5,172,881 | * | 12/1992 | Stein | 248/230.8 |
| 5,598,995 | | 2/1997 | Meuth et al. . | |
| 5,732,915 | | 3/1998 | Heard . | |
| 5,799,916 | | 9/1998 | Lechner . | |
| 6,065,772 | * | 5/2000 | Le Vaseum | 248/230.8 |

FOREIGN PATENT DOCUMENTS

| | | | | |
|---|---|---|---|---|
| 24467 | * | 8/1930 | (AU) | 248/230.8 |
| 603493 | * | 4/1960 | (IT) | 248/230.9 |

* cited by examiner

*Primary Examiner*—Alvin Chin-Shue
(74) *Attorney, Agent, or Firm*—Biebel & French

(57) ABSTRACT

A system for providing a support for mounting accessories to a generally cylindrical structure, such as a vertical cell tower structure. The system includes a support bracket having a facing surface located in engagement with a surface of the structure. A flexible member extends around the structure and is engaged with opposing ends of the support bracket for holding the support bracket in position on the structure. A first tensioning device is provided and detachably mounts to the support bracket to provide a first, pretension force to the flexible member. A second tensioning device is provided for providing a second force greater than the first force whereby a clamping force is provided to the flexible member to positively clamp the support bracket in position on the structure. The first tensioning device is removed from the support bracket and replaced with an accessory mounting bracket for supporting accessories on the structure at the support bracket. The support bracket is provided with deformable members extending outwardly from the facing surface wherein the deformable members deform in toward the facing surface as tension is applied to the flexible member. The tabs provide two contact points spaced outwardly from the contact point of the facing surface with the structure to provide a stable three point configuration for supporting the accessory on the structure.

7 Claims, 10 Drawing Sheets

MOUNTING BRACKET SYSTEM FOR SUPPORTING ACCESSORIES ON A STRUCTURE

BACKGROUND OF THE INVENTION

The present invention relates generally to a system for providing a support for mounting accessories to a generally cylindrical structure and, more particularly, to a system including a bracket which may be mounted to a wide range of structure diameters and which may be easily mounted to the structure without compromising the structural integrity of the structure.

There is a need for means to provide a mounting bracket on an existing structure, such as a vertically extending cylindrical structure, in order to support equipment or accessories which were not contemplated when the structure was erected. For example, cell towers comprising upwardly tapered, generally cylindrical structures, have been erected throughout the country to facilitate cellular phone usage. As usage of cellular phones and other electronic equipment increases, there is an increasing need for additional equipment and accessories, such as additional antennas and cables, to be placed on the cell towers. Alternatively, in some locations, there is a need to attach additional equipment or accessories to other elevated structures, such as attachment to the cylindrical legs of water towers and the like.

Various mechanisms for supporting the equipment and accessories have been proposed and typically include a support bracket which is attached to the vertical structure. In some instances, holes are drilled in the structure to permit bolts to be used to mount the brackets directly to the structure. However, the structural requirements of the structure are carefully engineered and provision of additional holes, particularly if a large number of brackets must be mounted to the structure, may structurally compromise the structure and therefore often requires reengineering to ensure that the additional holes do not jeopardize the strength of the structure.

In other instances, the brackets may be welded to the structure. Welding has its own limitations in that the welded surfaces must be clean in order to obtain a good weld, and the welding equipment is often heavy and bulky, which is not conducive to operations involving extreme heights.

A further method for supporting brackets on cylindrical structures involves providing a flexible clamping strap extending around the structure and having opposing ends attached to the bracket. For example, U.S. Pat. No. 1,432,561 shows a bracket which is held to a telephone pole by means of a chain wrapped around the pole and having ends tensioned at the bracket. U.S. Pat. No. 5,598,995 also shows a tensioned flexible member which forces a clamp assembly into contact with a cylindrical support to thereby hold the clamp assembly at a desired location.

The prior art devices incorporating flexible straps to hold clamp assemblies or brackets at a desired location on a structure are typically designed for a limited size diameter structure and are not designed for universal use on a wide range of structures. Further, it should be noted that on large structures, the frictional forces between the strap and structure are such that it is difficult to manually draw the strap to eliminate all slack in the strap prior to exerting a clamping force through the strap. As a result, it has been found that the mechanism for drawing the clamping force may not have enough travel to both take up the remaining slack in the strap and exert the required clamping force for holding the clamp assembly or bracket at the desired location.

SUMMARY OF THE INVENTION

The present invention provides a system for providing a support for mounting accessories to generally cylindrical structures. The system includes a support bracket including a facing surface for locating in a position on the cylindrical structure with the facing surface facing toward the surface of the structure. The support bracket includes first and second opposing ends and first and second attachment portions located at each of the first and second ends. A flexible member extends around the structure and attaches to the first and second attachment portions. In addition, a deformable portion is located on and extends from the facing surface for engaging the surface of the structure. The deformable portion deforms in response to tension on the flexible member.

In the preferred embodiment, the deformable portion comprises first and second discrete members formed as lanced tabs extending from the facing surface, and the tabs extend at an obtuse angle relative to the facing surface. When the bracket is initially supported on the cylindrical structure, the tabs hold the facing surface in spaced relation to the structure. As tension is applied to the flexible member, the tabs deform outwardly in opposing directions from each other and toward the facing surface of the bracket, thereby permitting the bracket to move toward contact with the surface of the structure. Upon contact of the facing surface with the structure, three points of contact between the bracket are defined to provide a stable engagement configuration between the bracket and structure which is designed to prevent wobbling or other movement of the bracket.

It should be understood that the deformation of the tabs will vary depending on the particular diameter of the structure. Thus, the bracket of the present invention may accommodate a wide range of structural diameters.

In a further aspect of the invention, the bracket includes an accessory mounting side facing oppositely from the facing surface wherein the accessory mounting side includes means to detachably mount a first tensioning device for applying a first, pretension force to the flexible member. In addition, at least one of the first and second attachment portions include a second tensioning device for applying a second force to the flexible member greater than the first, pretension force, the second force being a clamping force for maintaining the bracket in a desired position on the structure.

The first tensioning device is removed from the bracket subsequent to application of the first, pretension force, and an accessory is attached to the bracket at the accessory mounting side, such that the same location on the bracket may be used both for a first tensioning device and for an accessory mounting device.

Therefore, it is an object of the present invention to provide a system for mounting an accessory to a structure wherein the system may be used with a wide range of structure diameters.

It is a further object of the invention to provide a system for mounting an accessory to a structure including first and second tensioning devices for tensioning a flexible member holding the system to the structure.

It is yet another object of the invention to provide a mechanism for removably mounting a tensioning device for providing a first, pretension force to the flexible member.

It is still another object of the invention to provide a mounting bracket designed to alternatively mount a tensioning device and an accessory supported by the bracket.

Other objects and advantages of the invention will be apparent from the following description, the accompanying drawings and the appended claims.

DETAILED DESCRIPTION OF THE PREFERRED EMBODIMENT

Figure 1:
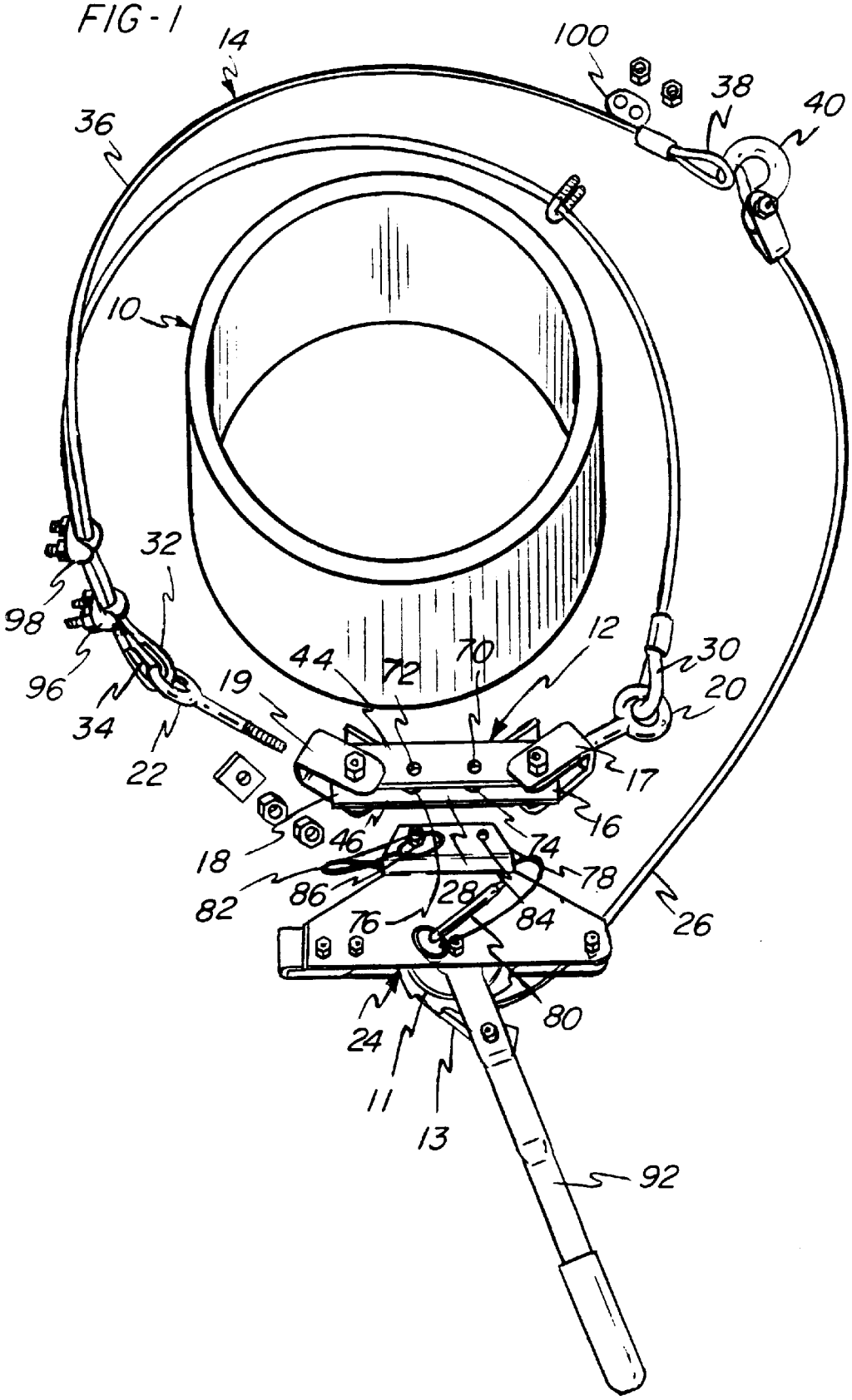
FIG. 1 is a perspective view of the system of the present invention showing the elements located relative to a cylindrical structure.

Referring initially to FIG. 1, the system of the present invention is shown in relation to a cylindrical structure 10. The system generally includes a support bracket 12 and a flexible member 14, shown here as a cable, which is attached to opposing ends 16 and 18 of the support bracket 12 at first and second attachment portions defined by respective eye bolts 20, 22 supported by clevis members 17, 19.

The system further includes a first tensioning device 24, illustrated here as a conventional cable puller device, which includes a ratchet mechanism, such as a ratchet wheel 11, engaged by a spring biased pawl 13 on an oscillating lever 92, for drawing a flexible member 26 in tension. The first tensioning device 24 is adapted to be mounted to the support bracket 12 on an accessory mounting side 28 of the support bracket 12.

One end 30 of the flexible member 14 is affixed to the eye bolt 20 to define a first attachment portion of the flexible member 14. A second attachment portion 32 of the flexible member 14 is defined at the second eye bolt 22 where the flexible member 14 extends through the eye bolt 22 and around a guide 34. An end portion 36 of the flexible member 14 doubles back around the structure 10 toward the first attachment portion at the first end 30 of the flexible member 14. The end portion 36 of the flexible member 14 terminates in a second end 38 which is formed as a loop or eye which receives a hook or other temporary attachment element 40 at the free end of the flexible member 26 of the first tensioning mechanism 24.

Figure 2:
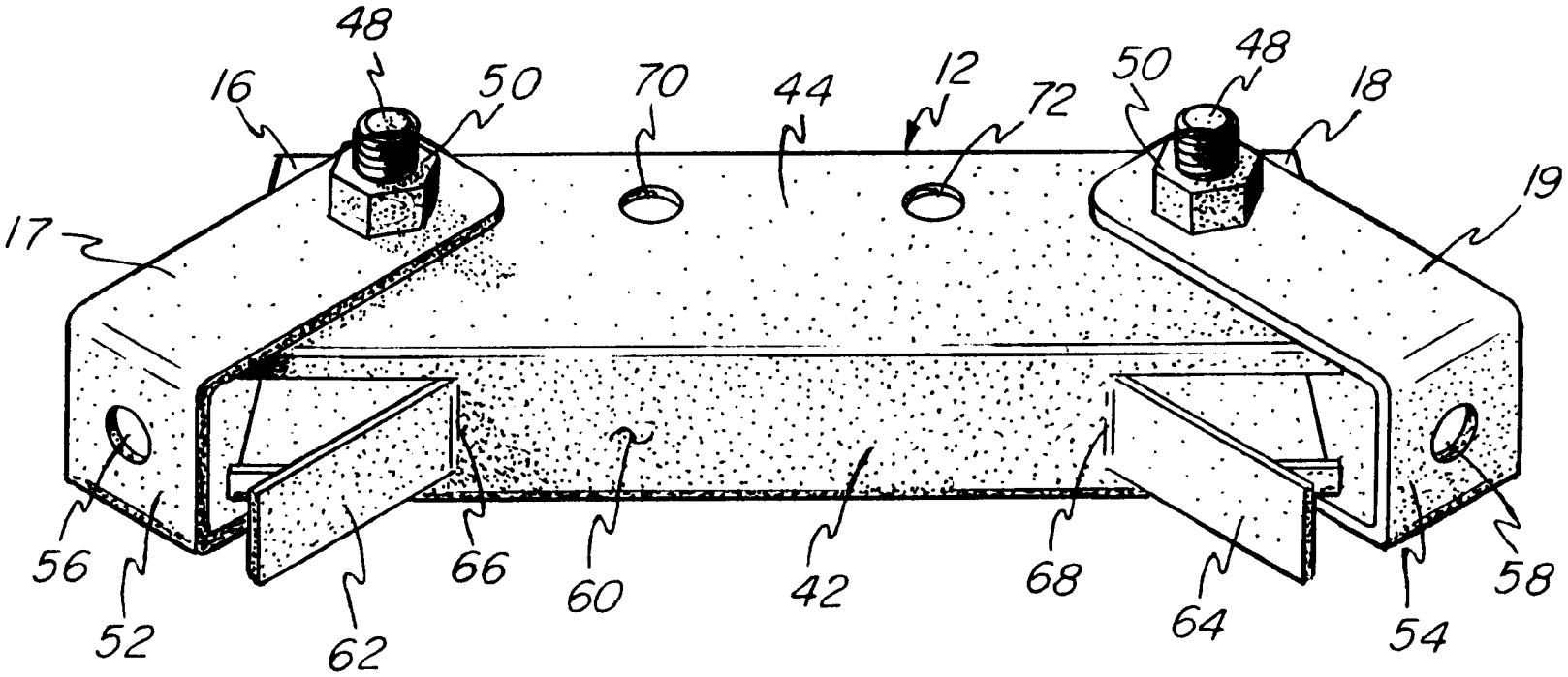
FIG. 2 is a perspective view showing the facing side of the support bracket for the present system.

Referring to FIGS. 1 and 2, the support bracket 12 is formed as a U-shaped member defined by a facing wall 42 and generally parallel side walls 44, 46 extending from the facing wall 42. The clevis members 17, 19 are pivotally attached to the side walls 44, 46 by means of threaded fasteners 48 passing through aligned apertures in the side walls 44 and clevis members 17, 19, and the fasteners 48 are held in place by means of threaded nuts 50. It should be noted that each of the clevis members 17, 19 include a respective end plate 52, 54, each of which defines an aperture 56, 58 for receiving the threaded shank of one of the eye bolts 20, 22.

The facing wall 42 defines a facing surface 60 for engaging an outer surface of the structure 10. Tabs 62, 64 are provided formed integrally with and extending from the facing surface 60 at the opposing ends 16, 18 of the support bracket 12, and are defined as lanced portions of the facing wall 42. Each of the tabs 62, 64 extend from a respective interface 66, 68 with the facing surface 60 at an obtuse angle relative to the facing surface 60. The tabs 62, 64 define a deformable portion of the bracket 12 which deform inwardly toward the facing surface 60 of the bracket 12 as the flexible member 14 is tightened around the structure 10, as will be described in greater detail below.

The support bracket 12 further includes a plurality of apertures 70, 72, 74, 76 defined in the side walls 44 and 46. The apertures 70, 74 are aligned with each other, and the apertures 72, 76 are also aligned with each other for receiving elongated fastener members 80, 82 therethrough to attach the first tensioning device 24 to the support bracket 12. Specifically, the first tensioning device 24 includes a base portion 78 which is adapted to be received between the side walls 44, 46 and which includes apertures 84, 86 for aligning with the pairs of apertures 70, 74 and 72, 76 for receiving the elongated fasteners 80, 82 and thereby detachably mounting the first tensioning device 24 in place on the support bracket 12. For this purpose the fastener members 80, 82 are preferably ball detent pins.

Figure 3:
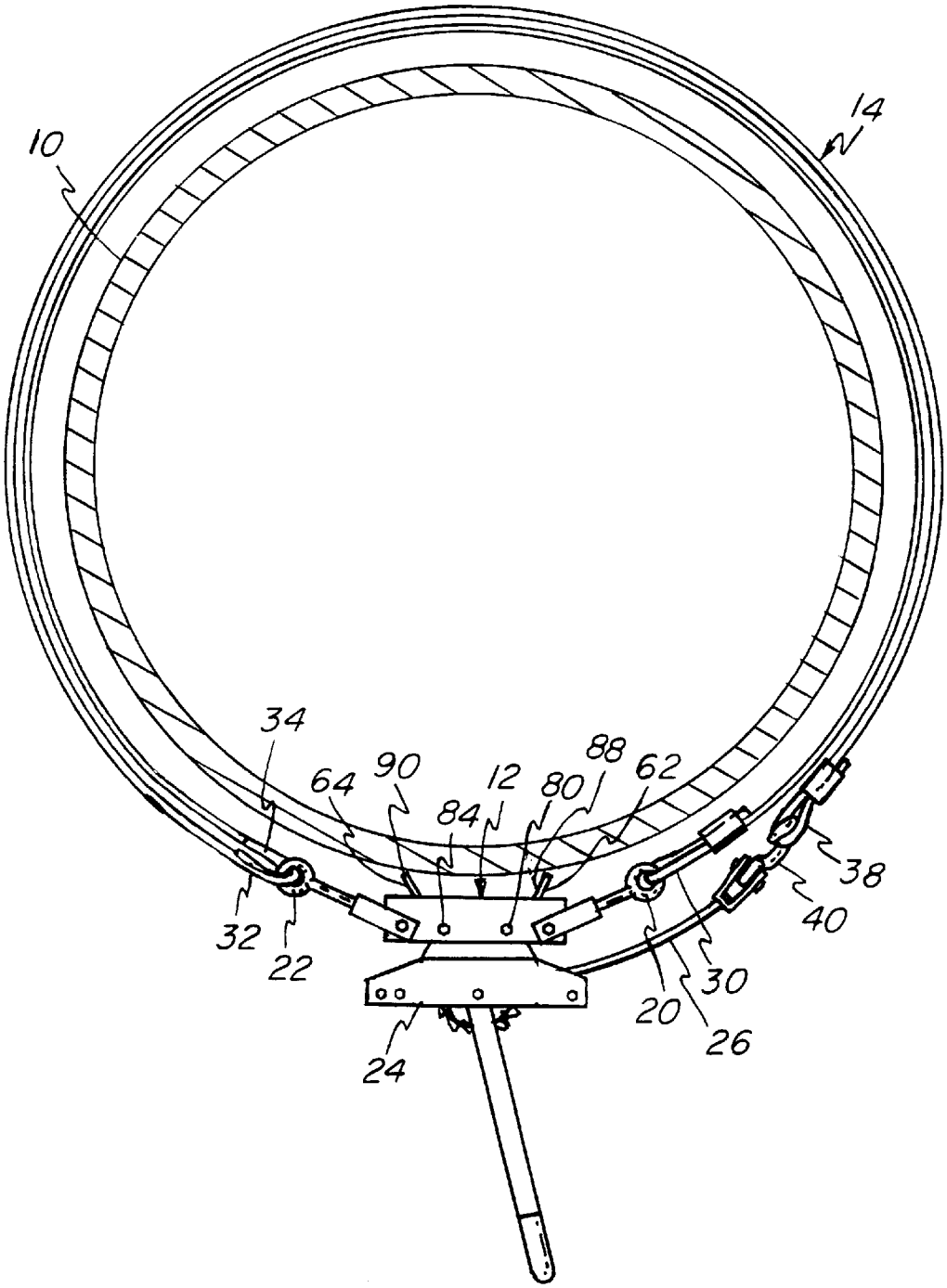
FIG. 3 is a top plan view illustrating an initial position of the system of the present invention prior to tensioning of the flexible member.

Referring to FIG. 3, the system of the present invention is used to mount the support bracket 12 to the structure 10 by initially extending the flexible member 14 around the structure 10 wherein the first end 30 of the flexible member 14 is attached to the eye bolt 20, and the second portion 32 of the flexible member is passed in sliding contact through the eye bolt 22 and around the guide 34. Further, the first tensioning device 24 is mounted in the bracket 12 and held in place by the fasteners 80, 82 with the free end 40 of the flexible member 26 engaged with the free end 38 of the flexible member 14.

Figure 3A:
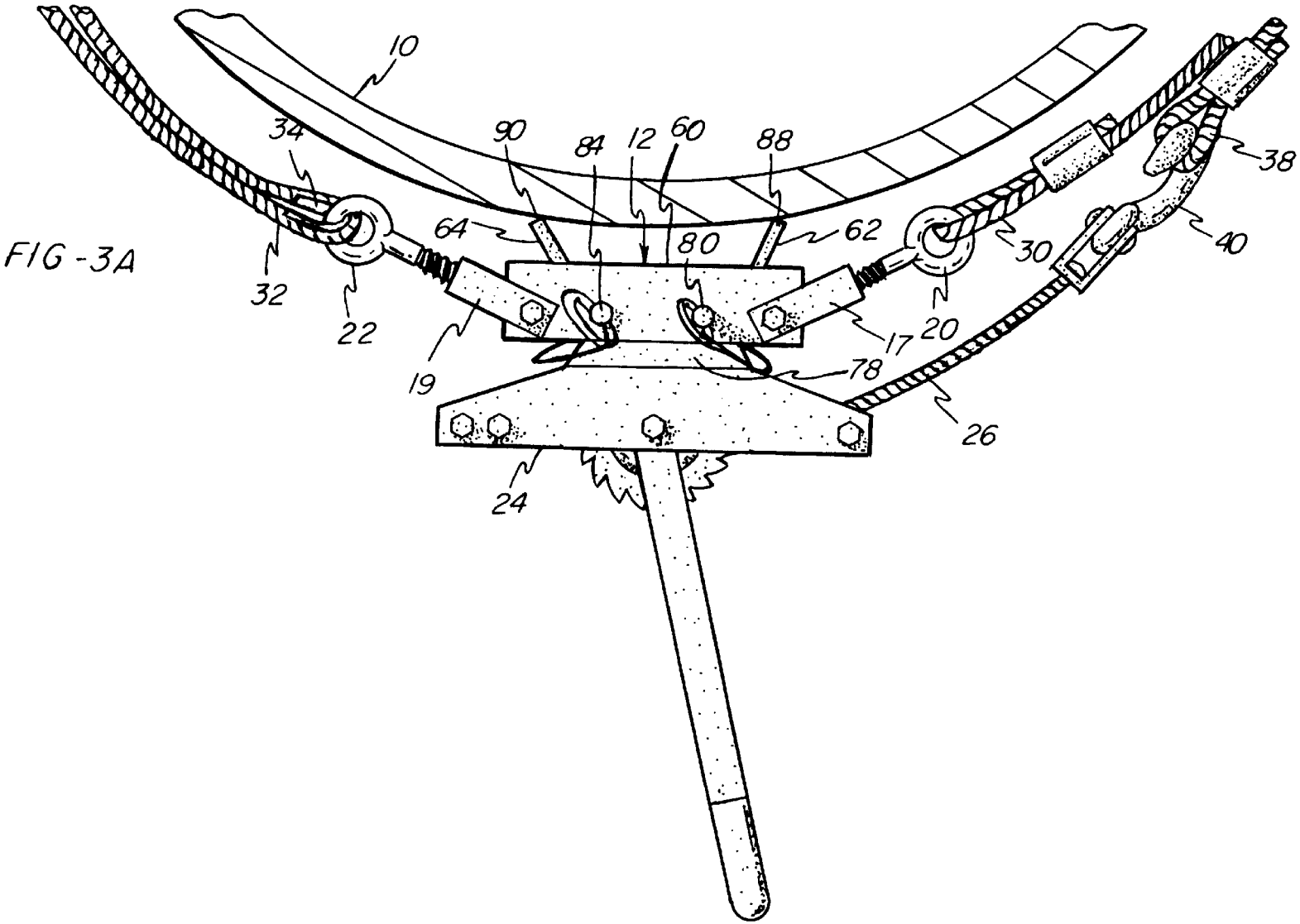
FIG. 3A is an enlarged view of the support bracket shown in FIG. 3.

In the position shown in FIG. 3, and as shown enlarged in FIG. 3A, the outer edges 88, 90 of the tabs 62, 64 are located in contact with the outer surface of the structure 10, and the facing surface 60 of the support bracket 12 is located in spaced relation to the structure 10.

As the handle 92 of the first tensioning device 24 is moved in oscillating movement to actuate the ratchet mechanism, the flexible member 14 is tensioned with a first, pretension force sufficient to overcome any frictional forces between the flexible member 14 and the outer surface of the structure 10 such that the slack in the flexible member 14 is substantially and effectively removed. In addition, during application of the first pretension force by the first tensioning device 24, the clevis members 17, 19 pivot to align with the particular diameter of the structure 10 and the support bracket 12 is drawn toward the structure 10 wherein the outer edges 88, 90 of the tabs 62, 64 slide outwardly away from each other as the tabs 62, 64 deform or bend in movement toward the facing surface 60 of the support bracket 12.

Figure 4:
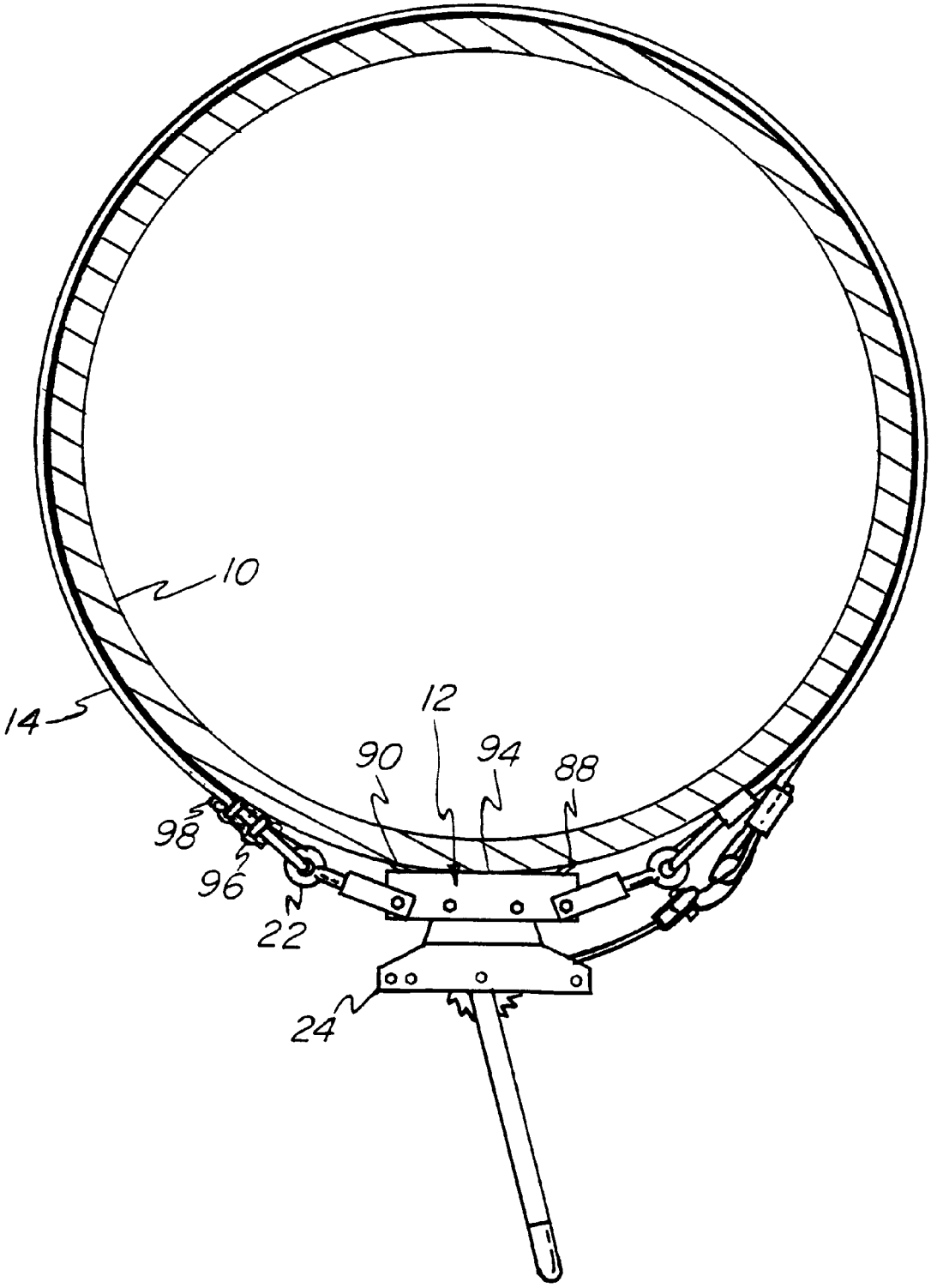
FIG. 4 is a view similar to FIG. 3 wherein a first, pretension force has been applied to the flexible member.
Figure 4A:
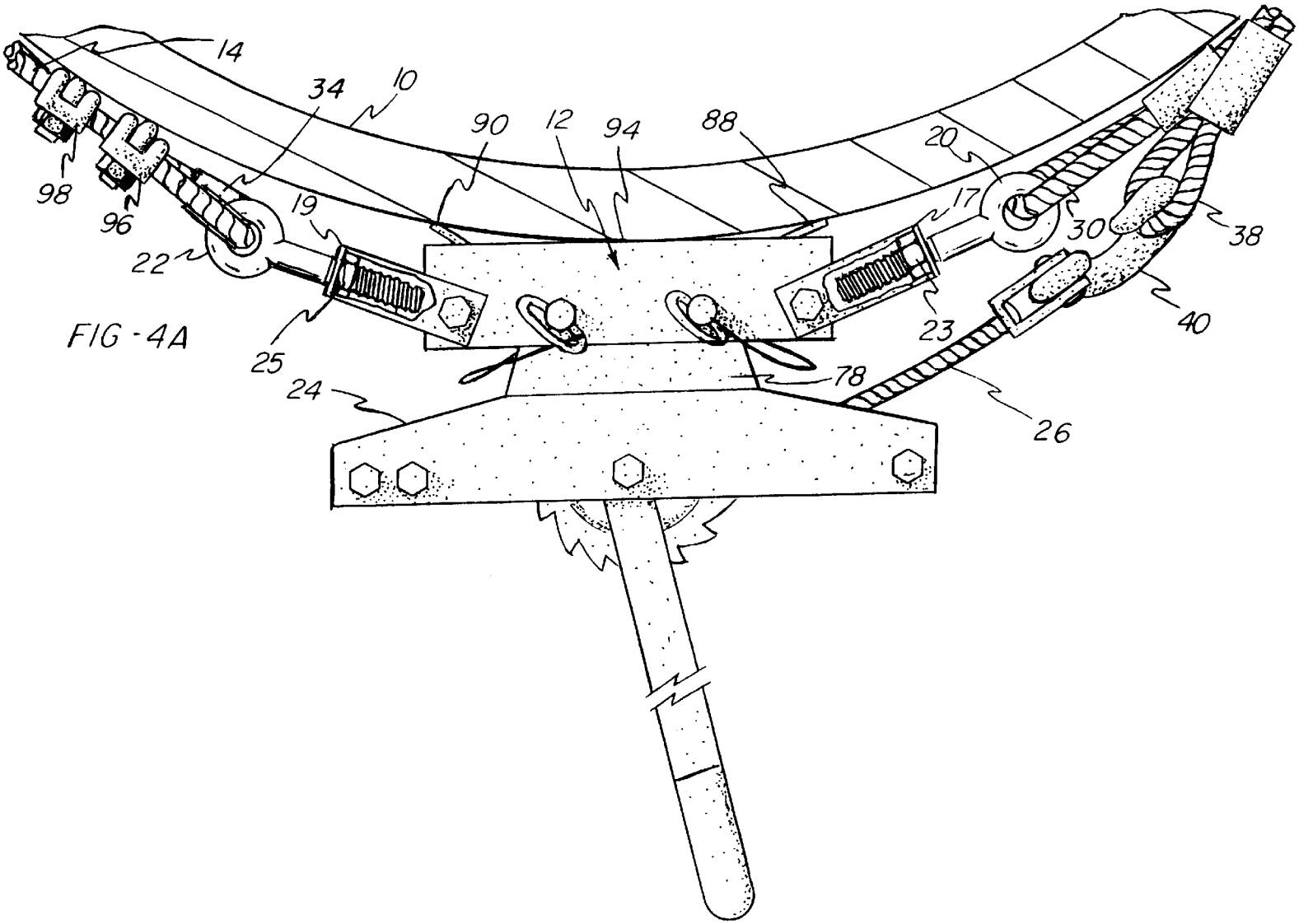
FIG. 4A is an enlarged view, partially cut away, of the support bracket shown in FIG. 4.

FIGS. 4 and 4A illustrate the final position of the support bracket 12 on the structure wherein the facing surface 60 of the support bracket 12 engages the structure 10 at a point of contact 94 located between the points of contact defined by the edges 88, 90 of the tabs 62, 64. The support bracket 12 is in three point contact with the surface of the structure 10 to provide a stable support for the bracket 12 which will be resistant to forces tending to move or shift the bracket 12 relative to the structure 10.

Subsequent to application of the first, pretension force by the first pretensioning device 24, a pair of cable clamps 96, 98 clamp overlapping portions of the flexible member 14 together adjacent to the second eye bolt 22 whereby the pretension force in the flexible member 14 is maintained.

Figure 5:
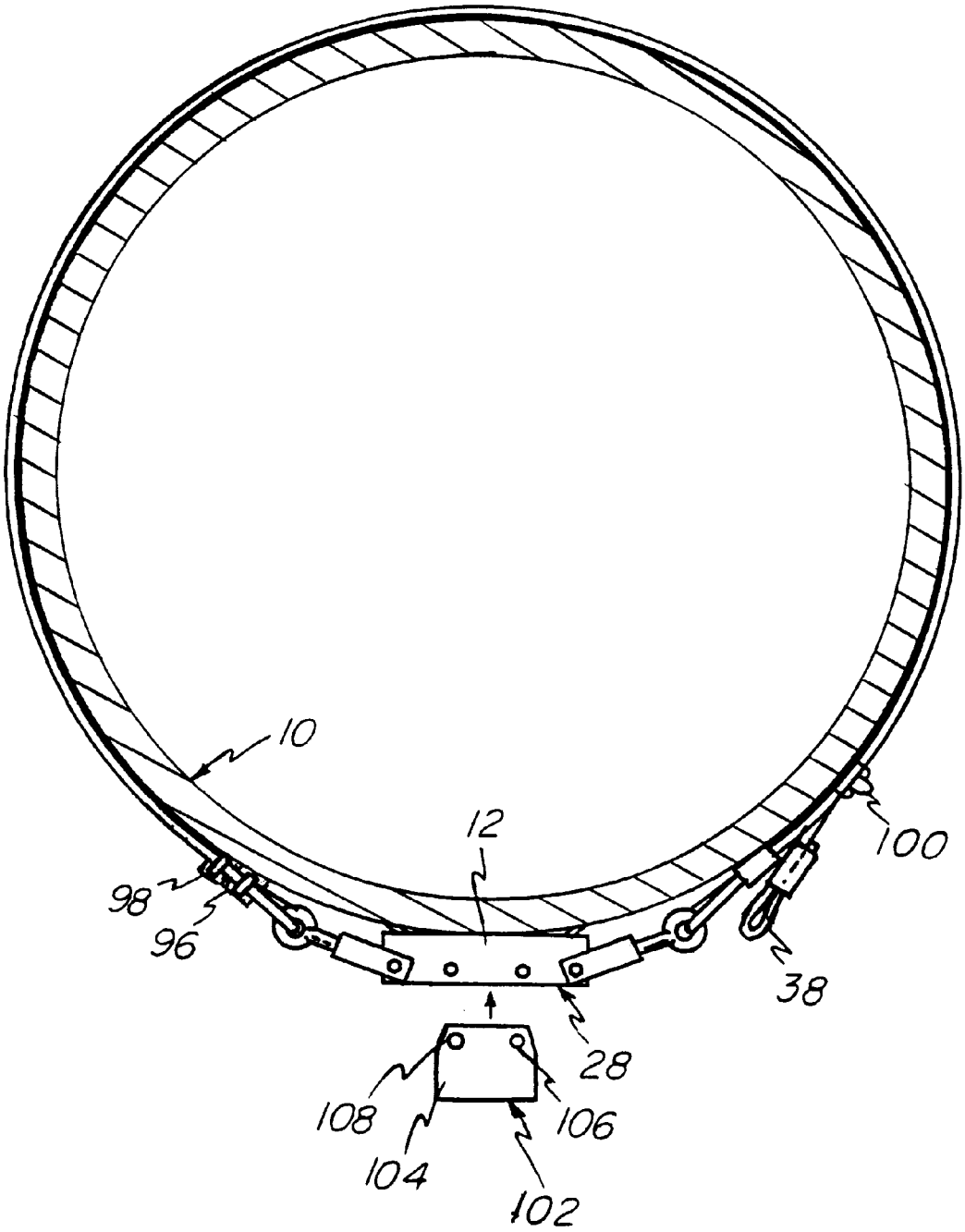
FIG. 5 is a view similar to FIGS. 3 and 4 wherein the first tensioning device has been removed and a clamping force has been applied to the flexible member by the second tensioning device.

Subsequently, as seen in FIG. 5, the fasteners 80, 82 are removed to release the first tensioning device 24 from the support bracket 12, and the eye bolts 20, 22 are operated as a second tensioning device wherein respective nuts 23, 25 (see FIG. 4A) are rotated to draw the shanks of the eye bolts 20, 22 into their respective clevis members 17, 19 to provide a second, clamping force to the flexible member 14 which is greater than the first, pretension force provided by the first tensioning device 24. An additional cable clamp 100 is then provided to hold the free end 38 of the flexible member in place on the flexible member 14.

After the support bracket 12 is tensioned in place with the flexible member 14, an accessory mounting bracket 102 is mounted to the mounting side 28 of the support bracket 12, and is typically in the form of a U-shaped bracket having parallel sides 104 (only one shown) wherein each side includes a pair of apertures 106, 108 for alignment with the pairs of apertures 70, 74 and 72, 76 of the support bracket 12, and the mounting bracket 102 is held in place on the support bracket 12 by means of fasteners passing through the apertures in a manner similar to that described above relating to mounting of the first tensioning device 24.

It should be noted that the present invention provides a substantial advantage over the prior art in that the first tensioning device 24 substantially takes up all slack in the flexible member whereby application of the second clamping force provided by the second tensioning device 20, 22, 23, 25 can be performed without risk of the shanks of the eye bolts 20, 22 being fully drawn into the clevis members 17, 19 prior to the required clamping force on the flexible member 14 being obtained.

A further advantage associated with the system of the present invention relates to the ability of the support bracket 12 to adjust to structures 10 having different diameters, and in particular, may be used on structures having sizes ranging from approximately 18 inches to 10 feet in diameter. Specifically, the clevis members 17, 19 pivot to conform to the structure 10 and the tabs 62, 64 will deform toward the facing surface 60 a greater amount with increasing diameter of the structure 10 whereby the support bracket 12 provides a stable mounting for the mounting bracket 102 over a large range of diameters without requiring a specially designed bracket to accommodate the differing diameter sizes.

Figure 6:
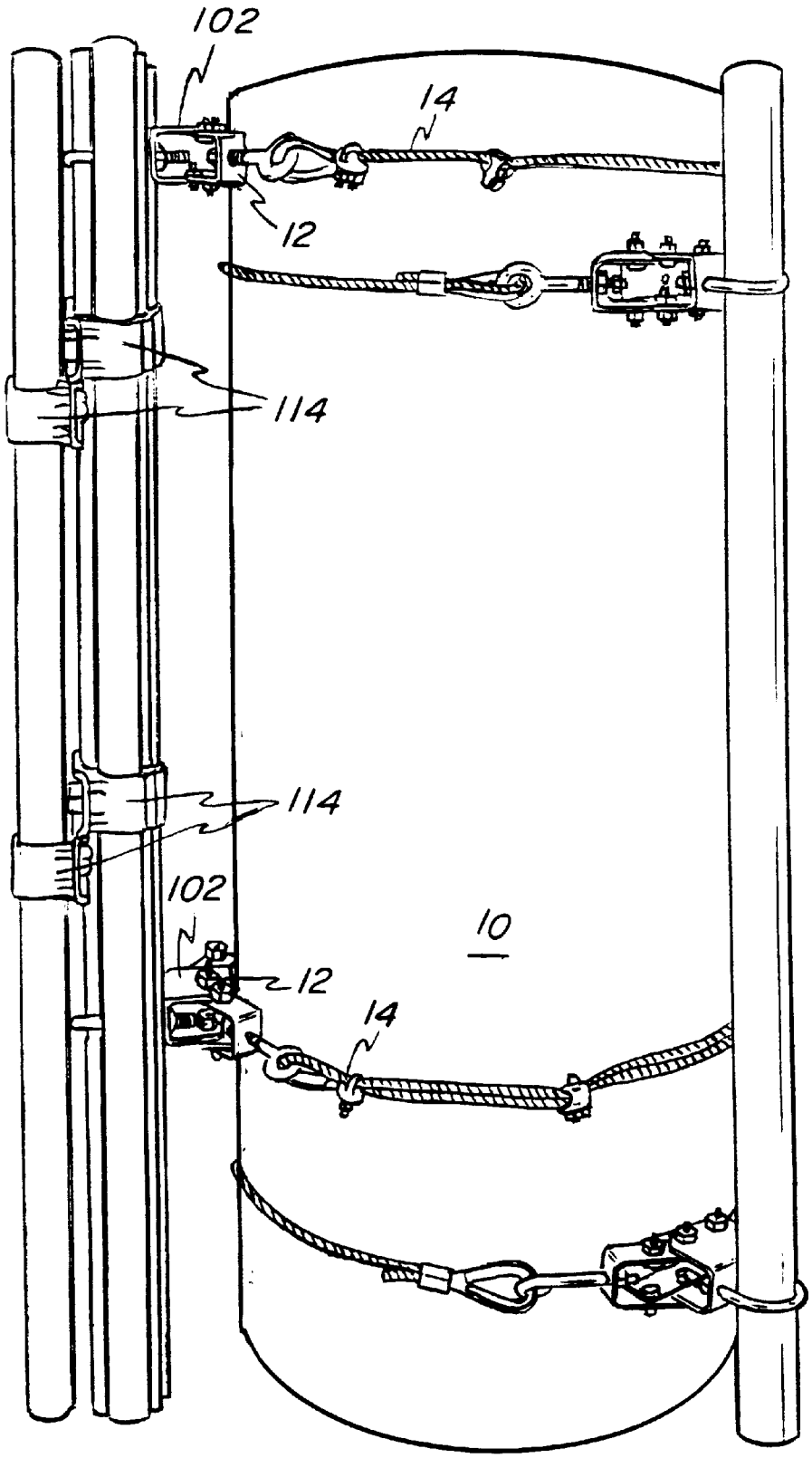
FIG. 6 is a side elevational view showing the present invention used to support vertically extending cables.
Figure 7:
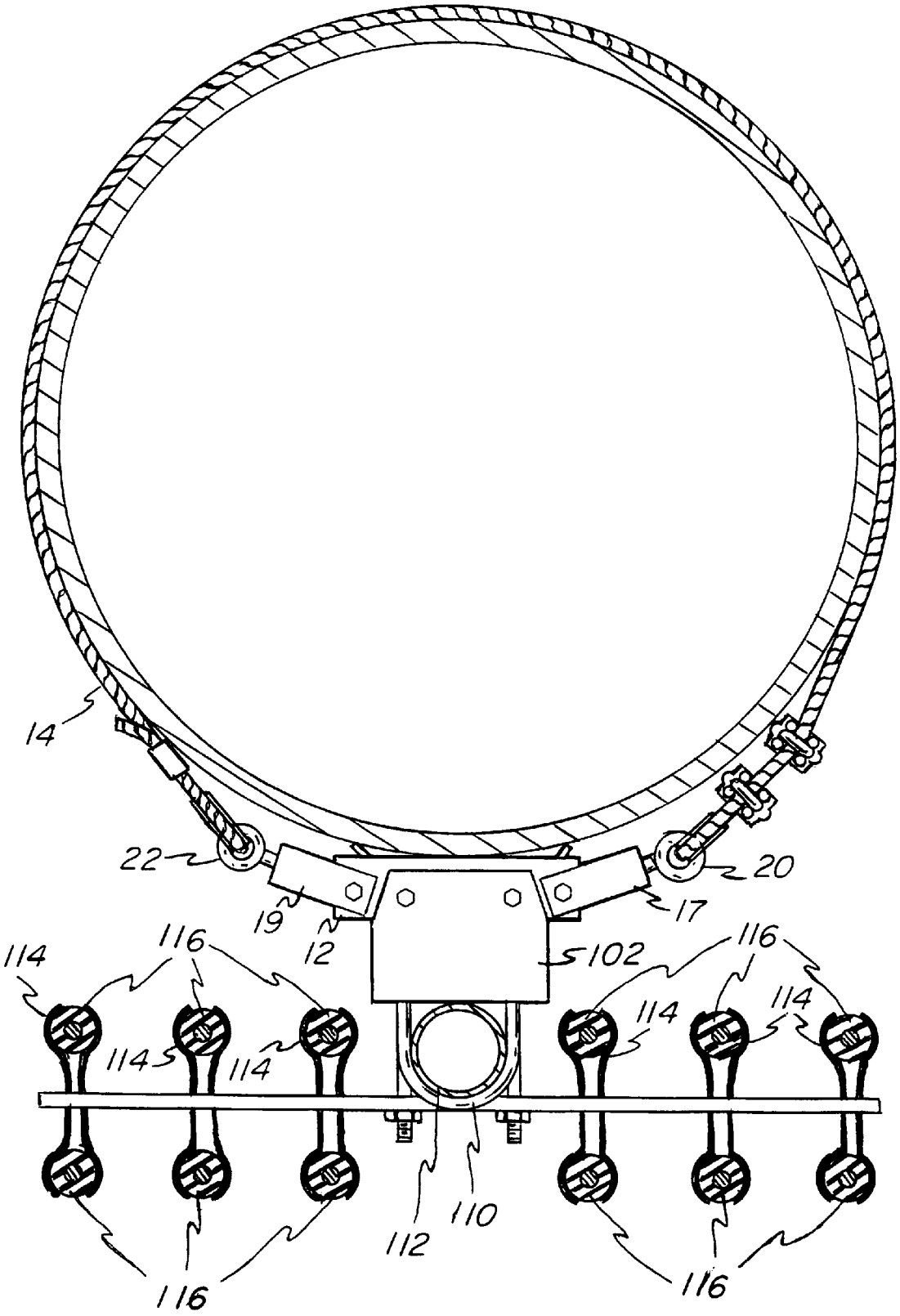
FIG. 7 is a top plan view showing the present invention supporting vertically extending cables.

Referring to FIGS. 6 and 7, an application of the system of the present invention is illustrated. In this application, the system is used to support a plurality of support brackets 12 spaced vertically along a vertical cylindrical structure 10. In this application, the support bracket 12 supports a mounting bracket 102 which in turn engages with a U-shaped conduit clamp 110 for mounting a conduit 112 to the support bracket 12. The conduit 112 is used to support a plurality of coax cable runs 114 whereby a plurality of coax cables 116 may be supported extending vertically up the structure 10.

Figure 8:
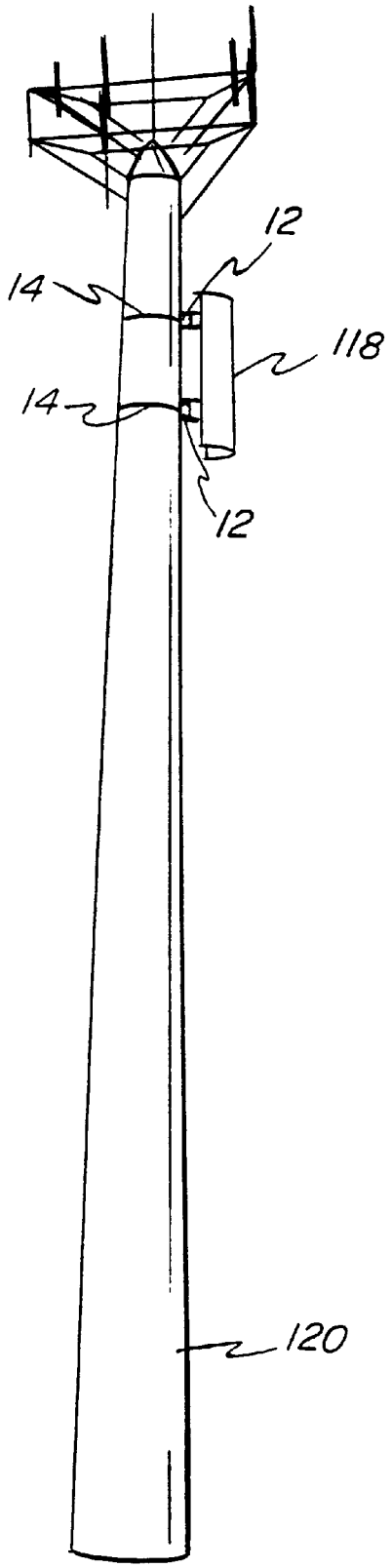
FIG. 8 is a view showing a cell tower on which two of the support brackets of the present invention are supported to mount an antenna/repeater panel.

FIG. 8 illustrates a further application of the system of the present invention wherein an antenna/repeater panel 118 is supported by a pair of support brackets 12 on a substantially cylindrical upwardly extending cell tower 120. It should be noted that in applications such as mounting equipment on upwardly tapered cell towers 120 such as is illustrated in FIG. 8, the support bracket 12 of the present invention is particularly useful in that it can accommodate the varying diameters provided on the cell tower 120.

In view of the above description of the present invention, it should be apparent that the present invention provides a system for effectively mounting accessories or other equipment to structures without requiring structural alteration of the structure. Further, the support bracket of the present system is adapted to be mounted to a variety of structures having different diameters to provide a stable support for a mounted accessory. In addition, the present system provides a method of mounting a support bracket which provides for an initial pretensioning of a flexible member for holding the support bracket to the structure, and application of a further clamping force for providing sufficient force to prevent movement of the bracket from its mounting position.

While the form of apparatus and method herein described constitute preferred embodiments of this invention, it is to be understood that the invention is not limited to this particular apparatus and method, and that changes may be made therein without departing from the scope of the invention which is defined in the appended claims.

What is claimed is:

1. A system for providing a support for mounting accessories to generally cylindrical structures, said system comprising:

a support bracket including a longitudinally extending facing surface for locating in a position on a structure with the facing surface facing a surface of the structure;

first and second opposing ends defined by said support bracket;

first and second attachment portions located at said first and second ends, respectively;

a flexible member for extending around the structure and attaching to the first and second attachment portions a first tensioning device;

said bracket including an accessory mounting side facing oppositely from said facing surface, said accessory mounting side including means to detachably mount said first tensioning device for applying a first, pretension force to said flexible member, and said means to detachably mount a first tensioning device comprising an elongated facing wall, defining said facing surface, and a pair of generally parallel side walls to define said support bracket as a U-shaped structure including an open interior area located centrally between said first and second opposing ends, for receiving said first tensioning device;

said first tensioning device comprising a base portion supporting a ratchet mechanism actuated by an oscillating handle, and further including a flexible tensioning element connected to said ratchet mechanism and having an end attached to a temporary attachment element which is drawn toward said ratchet mechanism in response to oscillating movement of said handle, said flexible member including an end cooperating with said temporary attachment element whereby tensioning of said flexible tensioning element results in tensioning of said flexible member;

said base portion of said first tensioning device fitting between said pair of side walls, said base portion and said side walls including aligned apertures receiving removable pins defining said means to detachably mount said first tensioning device, whereby removal of said pins releases said base portion and ratchet mechanism from said support bracket;

each of said attachment portions comprising U-shaped clevis members pivotally attached to said side walls, and each of said clevis member defining an open area facing toward the open interior area of said support bracket; and at least one of said clevis members including a second tensioning device for applying a second force to said flexible member greater than said first, pretension force wherein said second tensioning member comprises a threaded member extending through said at least one clevis member and a nut threadably engaged on said threaded member for drawing said threaded member into said open area of said at least one clevis member to apply said second force to said flexible member.

2. The system as in claim 1 wherein said means to detachably mount said first tensioning device comprises removable members for holding the first tensioning device in place on said bracket, and including an accessory for mounting to said bracket in place of said first tensioning device, said accessory comprising means for receiving said removable members when said accessory is mounted to said bracket whereby the accessory is supported on the structure.

3. The system as in claim 1 wherein said interior area of said bracket and said open area of said at least one clevis member provide a line of access to said nut on said threaded member located within said at least one clevis member.

4. The system as in claim 1 wherein said first tensioning device comprises a ratchet element engaged by a pawl element.

5. The system of claim 1 wherein said support bracket includes a deformable portion comprising first and second discrete members defined by lanced tabs located on and extending from said facing surface adjacent said first and second ends, respectively.

6. The system of claim 5 wherein said tabs each extend at an obtuse angle relative to said facing surface.

7. The system of claim 5 wherein an interface is defined between each of said tabs and said facing surface and including a contact face defined on each said tab for engaging the surface of the structure wherein said tabs deform at said interfaces, and said contact faces slidable across the structure in opposing directions in response to tension applied to said flexible member whereby a center portion of said support bracket facing surface defines a contact point positioned to contact with the surface of the structure to define three points of contact between the support bracket and the structure.

* * * * *